US007183029B2

(12) United States Patent
Masuda et al.

(10) Patent No.: US 7,183,029 B2
(45) Date of Patent: Feb. 27, 2007

(54) DRY TONER, TONER KIT, AND IMAGE FORMING APPARATUS AND PROCESS CARTRIDGE USING THE DRY TONER

(75) Inventors: Minoru Masuda, Numazu (JP); Mitsuo Aoki, Numazu (JP); Kumi Hasegawa, Numazu (JP); Bing Shu, Mishima (JP)

(73) Assignee: Ricoh Company, Limited., Tokyo (JP)

( * ) Notice: Subject to any disclaimer, the term of this patent is extended or adjusted under 35 U.S.C. 154(b) by 0 days.

(21) Appl. No.: 10/935,582

(22) Filed: Sep. 8, 2004

(65) Prior Publication Data

US 2005/0064310 A1 Mar. 24, 2005

(30) Foreign Application Priority Data

Sep. 18, 2003 (JP) ..... 2003-326035

(51) Int. Cl.
*G03G 9/10* (2006.01)

(52) U.S. Cl. ..... 430/107.1; 430/109.4; 399/252; 528/279

(58) Field of Classification Search ..... 430/107.1, 430/109.4; 528/279; 399/252
See application file for complete search history.

(56) References Cited

U.S. PATENT DOCUMENTS 6,007,958 A * 12/1999 Ito et al. ..... 430/109.4
6,080,519 A * 6/2000 Ishiyama et al. ..... 430/110.3
6,413,691 B2 * 7/2002 Daimon et al. ..... 430/109.4
6,566,026 B2 5/2003 Watanabe et al.
6,660,443 B2 12/2003 Sugiyama et al.
6,733,939 B2 5/2004 Nanya et al.
2002/0025184 A1 * 2/2002 Ishikawa et al. ..... 399/111
2004/0241565 A1 * 12/2004 Kishiki et al. ..... 430/109.4

OTHER PUBLICATIONS

U.S. Appl. No. 11/408,031, filed Apr. 21, 2006, Shu et al.
U.S. Appl. No. 11/336,909, filed Jan. 23, 2006, Masuda.

* cited by examiner

*Primary Examiner*—Mark A. Chapman
(74) *Attorney, Agent, or Firm*—Oblon, Spivak, McClelland, Maier & Neustadt,P.C.

(57) ABSTRACT

A toner for forming a full color image, which includes a colorant and a binder resin including a polyester resin which is prepared by a polycondensation ester reaction in the presence of a titanium-containing catalyst selected from the group consisting of halogenated titanium, titanium diketone enolates, titanium carboxylates, titanyl carboxylates, and salts of titanyl carboxylates. A toner kit including a yellow toner, a magenta toner, a cyan toner and a black toner, wherein each of the toners is the toner mentioned above. An image forming apparatus including an image bearing member; a charger; a light irradiator; a developing device configured to develop an electrostatic latent image with a developer including the toner mentioned above; a transfer device; and a fixing device.

13 Claims, 3 Drawing Sheets

DRY TONER, TONER KIT, AND IMAGE FORMING APPARATUS AND PROCESS CARTRIDGE USING THE DRY TONER

BACKGROUND OF THE INVENTION

1. Field of the Invention

The present invention relates to a dry toner for use in developing an electrostatic latent image formed by a method such as electrophotography and electrostatic recording. In addition, the present invention also relates to a toner kit containing the dry toner and an image forming apparatus and a process cartridge using the dry toner.

2. Discussion of the Background

When a polyester resin is used as a binder resin of toner, the resultant toner has the following advantages:

(1) The toner can be fixed by a heat roller fixing device at a relatively low fixing temperature (i.e., the toner has good low temperature fixability); and (2) Even when the toner is fixed by a heat roller fixing device at a relatively high temperature, the toner does not cause a hot offset problem in that the toner image adhere to the fixing rollers, and the transferred toner image is re-transferred to a receiving material, resulting in formation of an undesired image (i.e., the toner has good hot offset resistance).

Therefore, polyester resins are typically used for toner.

Recently, electrophotographic color copiers and printers have been popularly used. Color copy images are required to have high gloss. In order to produce a color toner which has good hot offset resistance and which can produce color images having high gloss, using a polyester resin as the binder resin of the color toner is effective.

However, conventional toners including a polyester resin have a drawback in that toner particles adhere to each other when being agitated with an agitator in a developing device, resulting in formation of the aggregate of the toner particles. Particularly, since color toner includes a relatively large amount of polyester resin to produce glossy images, a relatively large amount of aggregated toner particles are formed.

In addition, recently a need for high definition images increases more and more. Therefore, toner having a relatively small particle diameter is typically used. Toner having a small particle diameter typically has poor resistance to heat, pressure and impact. Therefore, toner having a small particle diameter produces a relatively large amount of aggregated toner particles.

When toner is used for a two component developing method, the toner is aggregated by the compression pressure due to collision of carrier particles. In a case of one component developing method, toner is aggregated by the pressure applied thereto by a blade and/or the heat generated by friction between a developing roller (or the blade) and the toner, when a toner layer is formed on the developing roller. In both cases, the toner achieves a semi-fused state due to the heat generated by friction between the toner and agitators or screws in the developing device used, resulting in occurrence of the aggregation problem.

When an electrostatic latent image is developed with a two component developer including aggregated toner particles, the aggregated toner particles adhere to the latent image, resulting in formation of a toner image including a large spot having a high density. In addition, since the aggregated toner particles serve as a spacer in the toner image transfer process without being transferred, the transferred toner image has an omission.

When an electrostatic latent image is developed with a one component developer including aggregated toner particles, the aggregated toner particles are sandwiched by the developing roller and the blade used for forming the toner layer, resulting in formation of a white streak in the resultant image. Particularly, such an abnormal image is relatively highly visible in color images compared to black and white images. In addition, the requirements (e.g., half tone properties, color reproducibility and resolution) for color images are generally severer than those for black and white images. Therefore, the aggregated toner particles present big problems for color images.

Because of these reasons, a need exists for a toner which includes a polyester resin as a binder resin and which has good low temperature fixability and good hot offset resistance and can produce glossy images without causing the above-mentioned undesired image problems.

SUMMARY OF THE INVENTION

Accordingly, an object of the present invention is to provide a toner which includes a polyester resin as a binder resin and which has good low temperature fixability and good hot offset resistance and can produce glossy images without causing the above-mentioned undesired image problems.

Another object of the present invention is to provide an image forming apparatus which can produce glossy images without causing the above-mentioned undesired image problems.

Briefly these objects and other objects of the present invention as hereinafter will become more readily apparent can be attained by a toner which includes at least a colorant and a binder resin including a polyester resin which is prepared by a polycondensation esterification reaction in the presence of a titanium-containing catalyst selected from the group consisting of halogenated titanium, titanium diketone enolate, titanium carboxylate, titanyl carboxylate, and salts of titanyl carboxylate. This toner is preferably used for forming full color images.

It is preferable that the toner further includes a wax.

The polyester resin preferably has a number average molecular weight of from 2,000 to 5,000 and a weight average molecular weight of from 10,000 to 30,000.

The toner preferably has a volume average particle diameter of from 3.0 to 7.5 μm.

As another aspect of the present invention, a toner kit is provided which includes a yellow toner, a cyan toner, a magenta toner and a black toner, wherein each of the toners is the toner mentioned above.

As yet another aspect of the present invention, an image forming apparatus is provided which includes an image bearing member, a charger configured to charge the image bearing member, a light irradiator configured to irradiate the charged image bearing member with imagewise light to form an electrostatic latent image on the image bearing member, a developing device configured to develop the electrostatic latent image with a developer including the toner mentioned above to prepare a toner image on the image bearing member, a transfer device configured to transfer the toner image on a receiving material and a fixing device configured to fix the toner image on the receiving material. The glossiness of the fixed image preferably has a glossiness of from 5 to 80%.

As a further aspect of the present invention, a process cartridge is provided which includes at least a developing device configured to develop an electrostatic latent image with the toner mentioned above to prepare a toner image and a housing.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
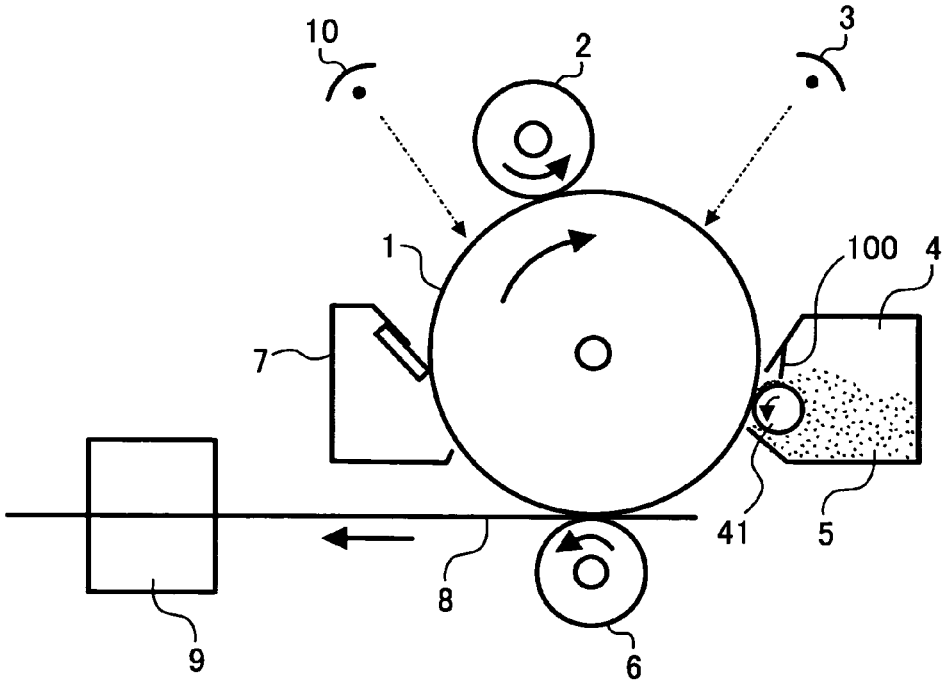
FIG. 1 is a schematic view illustrating an embodiment of the image forming apparatus of the present invention.

The toner of the present invention includes at least a colorant and a binder resin including a polyester resin which is prepared by a polycondensation esterification reaction in the presence of a titanium-containing catalyst selected from the group consisting of halogenated titanium, titandiketone elenotes, titanium carboxylates, titanyl carboxylates, and salts of titanyl carboxylates.

At first, the catalyst (A) will be explained.

Specific examples of the halogenated titanium (A-1) include titanium dichloride, titanium trichloride, titanium tetrachloride, titanium trifluoride, titanium tetrafluoride and titanium tetrabromide, but are not limited thereto.

Specific examples of the titanium diketone enolates (A-2) include titanium acetylacetonato, titanium diisopropoxide bisacetylacetonato and titanyl acetylacetonato, but are not limited thereto.

Specific examples of the titanium carboxylates (A-3) include titanium salts of aliphatic carboxylic acids having 1 to 32 carbon atoms (A-3•1) and titanium salts of aromatic carboxylic acids having 7 to 38 carbon atoms (A-3•2). In a case of titanium polycarboxylates having two or more carboxyl groups, the number of carboxyl groups coordinating titanium may be one or more, and a free carboxyl group which does not coordinate titanium can be present therein.

Specific examples of the titanium salts of aliphatic carboxylic acids (A-3•1) include titanium salts of aliphatic monocarboxylic acids (A-3•1*a*), titanium salts of aliphatic dicarboxylic acids (A-3•1*b*), titanium salts of aliphatic tricarboxylic acids (A-3•1*c*) and titanium salts of aliphatic polycarboxylic acids having 4 or more carboxyl groups (A-3•1*d*).

Specific examples of the titanium salts of aliphatic monocarboxylic acids (A-3•1*a*) include titanium formate, titanium acetate, titanium propionate, and titanium octanate, but are not limited thereto.

Specific examples of the titanium salts of aliphatic dicarboxylic acids (A-3•1*b*) include titaniumoxalate, titanium succinate, titanium maleate, titanium adipate, and titanium sebacate, but are not limited thereto.

Specific examples of the titanium salts of aliphatic tricarboxylic acids (A-3•1*c*) include titanium hexanetricarboxylate, and titanium isooctanetricarboxylate, but are not limited thereto.

Specific examples of the titanium salts of aliphatic polycarboxylic acids (A-3•1*d*) include titanium octanetetracarboxylate, and titanium decanetetracarboxylate, but are not limited thereto.

Specific examples of the titanium salts of aromatic carboxylic acids (A-3•2) include titanium salts of aromatic monocarboxylic acids (A-3•2*a*), titanium salts of aromatic dicarboxylic acids (A-3•2*b*), titanium salts of aromatic tricarboxylic acids (A-3•2*c*) and titanium salts of aromatic polycarboxylic acids having 4 or more carboxyl groups (A-3•2*d*).

Specific examples of the titanium salts of aromatic monocarboxylic acids (A-3•2*a*) include titanium benzozte, but are not limited thereto.

Specific examples of the titanium salts of aromatic dicarboxylic acids (A-3•2*b*) include titanium phthalate, titanium terephthalate, titanium isophthalate, titanium 1,3-naphthalenedicarboxylate, titanium 4,4-biphenyldicarboxylate, titanium 2,5-toluenedicarboxylate, and titanium anthracenedicarboxylate, but are not limited thereto.

Specific examples of the titanium salts of aromatic tricarboxylic acids (A-3•2*c*) include titanium trimellitate, and titanium 2,4,6-naphthalenetricarboxylate, but are not limited thereto.

Specific examples of the titanium salts of aromatic tetracarboxylic acids (A-3•2*d*) include titanium pyromellitate, and titanium 2,3,4,6-naphthalenetetracarboxylate, but are not limited thereto.

Among these titanium salts of carboxylic acids (A-3), titanium salts of aromatic carboxylic acids (A-3•2) are preferable and titanium salts of aromatic dicarboxylic acids (A-3•2) are more preferable.

Specific examples of the titanyl carboxylates (A-4) include titanyl aliphatic-carboxylate having 1 to 32 carbon atoms (A-4•1), and titanyl aromatic-carboxylate having 7 to 38 carbon atoms (A-4•2), but are not limited thereto. In the case of titanyl polycarboxylate having two or more carboxyl groups, the number of carboxyl groups coordinating titanium may be one or more, and a free carboxyl group which does not coordinate titanium can be present therein.

Specific examples of the titanyl aliphatic-carboxylates (A-4•1) include titanyl aliphatic-monocarboxylates (A-4•1*a*), titanyl aliphatic-dicarboxylates (A-4•1*b*), titanyl aliphatic-tricarboxylates (A-4•1*c*), and titanyl aliphatic-polycarboxylates having 4 or more carboxyl groups (A-4•1*d*).

Specific examples of the titanyl aliphatic-monocarboxylates (A-4•1*a*) include titanyl formate, titanyl acetate, titanyl propionate, and titanyl octanate, but are not limited thereto.

Specific examples of the titanyl aliphatic-dicarboxylates (A-4•1*b*) include titanyl oxalate, titanyl succinate, titanyl maleate, titanyl adipate, and titanyl sebacate, but are not limited thereto.

Specific examples of the titanyl aliphatic-tricarboxylates (A-4•1*c*) include titanyl hexanetricarboxylate, and titanyl isooctanetricarboxylate, but are not limited thereto.

Specific examples of the titanyl aliphatic-polycarboxylates (A-4•1*d*) include titanyl octanetetracarboxylate, and titanyl decanetetracarboxylate, but are not limited thereto.

Specific examples of the titanyl aromatic-carboxylates (A-4•2) include titanyl aromatic-monocarboxylates (A-4•2*a*), titanyl aromatic-dicarboxylates (A-4•2*b*), titanyl aromatic-tricarboxylates (A-4•2*c*), and titanyl aromatic-polycarboxylates having 4 or more carboxyl groups (A-4•2*d*).

Specific examples of the titanyl aromatic-monocarboxylates (A-4•2*a*) include titanyl benzozte, but are not limited thereto.

Specific examples of the titanyl aromatic-dicarboxylates (A-4•2*b*) include titanyl phthalate, titanyl terephthalate, titanyl isophthalate, titanyl 1,3-naphthalenedicarboxylate, titanyl 4,4-biphenyldicarboxylate, titanyl 2,5-toluenedicarboxylate, and titanyl anthracenedicarboxylate, but are not limited thereto.

Specific examples of the titanyl aromatic-tricarboxylates (A-4•2*c*) include titanyl trimellitate, and titanyl 2,4,6-naphthalenetricarboxylate, but are not limited thereto.

Specific examples of the titanyl aromatic-tetracarboxylates (A-4•2*d*) include titanyl pyromellitate, and titanyl 2,3,4,6-naphthalenetetracarboxylate, but are not limited thereto.

Specific examples of the salts of titanyl carboxylate (A-5) include alkali metal salts (such as lithium, sodium and potassium) and alkali earth metal salts (such as magnesium, calcium and barium) {(A-5•1*b*), (A-5•1*c*), (A-5•1*d*), (A-5•2*b*), (A-5•2) and (A-5•2*d*)} of the titanyl carboxylates (A-4•1*b*), (A-4•1*c*), (A-4•1*d*), (A-4•2*b*), (A-4•2*c*), and (A-4•2*d*).

Among these titanyl carboxylates (A-5), salts of titanyl maleate and salts of titanyl oxalate are preferable.

The added amount of the catalyst (A) is generally from 0.01% to 5% by weight, preferably from 0.02% to 2% by weight, more preferably from 0.03% to 1.5% by weight and even more preferably from 0.05% to 0.8% by weight, based on the total weight of the polyol and the polycarboxylic acid used for preparing the polyester resin. When the content is not less than 0.01%, the function of the catalyst as a polycondensation catalyst can be fully exerted. When the added amount is in the above-mentioned range, the effects of the added catalyst can be well produced. When a polyester resin is prepared using one or more catalysts (A) in an amount in the above-mentioned range and is used as a binder resin, the resultant toner has good properties and can produce high quality images even under low temperature and low humidity conditions.

Among these catalysts (A), titanium diketone enolates (A-2), titanium carboxylates (A-3), salts of titanyl carboxylates (A-5), and mixtures thereof are preferable, and titanium diketone enolates (A-2), titanium aromatic-carboxylates (A-3•2), salts of titanyl aliphatic-carboxylates (A-5•1) and mixtures thereof are more preferable. More preferably, titanium acetylacetonates, titanium aromatic-dicarboxylates (A-3•2*b*), alkali metal salts of titanyl aliphatic-dicarboxylates (A-5•1*b*), alkali metal salts of titanyl aromatic-dicarboxylates (A-5•2*b*), and mixtures thereof are used.

Particularly, titanium terephthalate, titanium isophthalate, titanium orthophthalate, salts of tintanyl oxalate, salts of titanyl maleate, and mixtures thereof are preferably used. Further, titanium terephthalate, potassium salt of titanyl oxalate and mixtures thereof are more preferably used.

Suitable polyester resins for use as the binder resin of the toner of the present invention include polyester resins (X) which are polycondensation products of a polyol and a polycarboxylic acid, and modified polyester resins (Y) which can be prepared by reacting the polyester resins (X) with a compound such as a polyepoxide (C), but are not limited thereto. These polyester resins (X) and (Y) can be used alone or in combination.

Suitable polyols include diols (G) and polyols (H) having three or more hydroxyl groups. Suitable polycarboxylic acids include dicarboxylic acids (I) and polycarboxylic acids (J) having three or more carboxyl groups.

The polycondensation reaction can be performed using a combination of a titanium-containing catalyst and another polymerization catalyst such as dioctyltin oxide, monobutyltin oxide, zinc acetate and tetrabutoxy titanate.

Specific examples of the polyester resins for use as the binder resin of the toner of the present invention include the following, but are not limited thereto:

(1) Linear polyester resins (X1) which are prepared using a diol (G) and a dicarboxylic acid (I);
(2) Non-linear polyester resins (X2) which are prepared using a diol (G), a dicarboxylic acid (I), and a polyol (H) and/or a polycarboxylic acid (J); and
(3) Modified polyester resins (Y1) which are prepared by reacting the non-linear polyester resins (X2) with a polyepoxide (C).

These resins can be used alone or in combination.

Suitable diols (G) include diols having a hydroxyl value of from 180 to 1900 mgKOH/g which is determined by a method described in JIS K 0070 incorporated by reference. Specific examples of the diols include alkylene glycols having 2 to 12 carbon atoms (e.g., ethylene glycol, 1,2-propylene glycol, 1,3-propylene glycol, 1,4-butylene glycol and 1,6-hexanediol); alkyleneether glycols (e.g., diethylene glycol, triethylene glycol, dipropylene glycol, polyethylene glycol, polypropylene glycol and polybutylene glycol); alicyclic diols (e.g., 1,4-cyclohexane dimethanol, and hydrogenetated bisphenol A); bisphenols (e.g., bisphenol A, bisphenol F and bisphenol S); adducts of alkylene oxides having 2 to 4 carbon atoms (e.g., ethylene oxide (EO), propylene oxide (PO) and butylene oxide (BO)) with the above-mentioned alicyclic diols; adducts of alkylene oxides having 2 to 4 carbon atoms with the above-mentioned bisphenols; etc.

Among these polyols, alkylene glycols having 2 to 12 carbon atoms, alkylene oxide adducts of bisphenols and combinations thereof are preferable, and alkylene oxide adducts of bisphenols and combinations of alkylene oxide adducts of bisphenols and alkylene glycols having 2 to 12 carbon atoms are more preferable.

Suitable polyols (H) include polyols having a hydroxyl value of from 150 to 1900 mgKOH/g. Specific examples of the polyols include aliphatic polyhydric alcohols having three or more hydroxyl groups (e.g., glycerin, triethylol ethane, trimethylol propane, pentaerythritol and sorbitol); adducts of alkylene oxides having 2 to 4 carbon atoms with the above-mentioned aliphatic polyhydric alcohols; trisphenols (e.g., trisphenol PA); novolak resins (e.g., phenol novolak and cresol novolak); adducts of alkylene oxides having 2 to 4 carbon atoms with the above-mentioned trisphenols; adducts of alkylene oxides having 2 to 4 carbon atoms with the above-mentioned novolak resins; etc.

Among these polyols, aliphatic polyhydric alcohols having three or more hydroxyl groups and adducts of alkylene oxides having 2 to 4 carbon atoms with novolak resins are preferable, and adducts of alkylene oxides having 2 to 4 carbon atoms with novolak resins are more preferable.

Suitable dicarboxylic acids (I) include dicarboxylic acids having an acid value of from 180 to 1250 mgKOH/g which is determined by a method described in JIS K 0070 incorporated by reference. Specific examples of the dicarboxylic acids include alkylene dicarboxylic acids having 4 to 36 carbon atoms (e.g., succinic acid, adipic acid, sebacic acid and dodecenyl succinate); alkenylenedicarboxylic acids having 4 to 36 carbon atoms (e.g., maleic acid and fumaric acid); aromatic dicarboxylic acids having 8 to 36 carbon atoms (e.g., phthalic acid, isophthalic acid, terephthalic acid and naphthalene dicarboxylic acid); etc.

Among these dicarboxylic acids, alkenylene dicarboxylic acids having 4 to 20 carbon atoms and aromatic dicarboxylic acids having 8 to 20 carbon atoms are preferable. These compounds can be used alone or in combination. In addition, anhydrides and lower-alkyl (C1–C4) esters (e.g., methyl, ethyl and isopropyl esters) of the above-mentioned dicarboxylic acids can also be used as the dicarboxylic acid.

Suitable polycarboxylic acids (J) include polycarboxylic acids having an acid value of from 150 to 1250 mgKOH/g. Specific examples of the polycarboxylic acids include aromatic polycarboxylic acids having 9 to 20 carbon atoms (e.g., trimellitic acid and pyromellitic acid); vinyl polymers of unsaturated carboxylic acids (e.g., styrene/maleic acid copolymers, styrene/acrylic acid copolymers, α-olefin/maleic acid copolymers, and styrene/fumaric acid copolymers); etc. Among these polycarboxylic acids, aromatic polycarboxylic acids having 9 to 20 carbon atoms are preferable, and trimellitic acid and pyromellitic acid are more preferable. In addition, anhydrides and lower-alkyl (C1–C4) esters (e.g., methyl, ethyl and isopropyl ester) of the above-mentioned polycarboxylic acids can also be used as the polycarboxylic acid. Further, copolymers of (G), (H), (I), (J) and hydroxycarboxylic acids (K) can also be used. Specific examples of the hydroxycarboxylic acids include hydroxystearic acid and hardened castor oils.

Specific examples of the polyepoxides (C) include polyglycidyl ethers (e.g., ethylene glycol diglycidyl ether, tetramethylene glycol diglycidyl ether, bisphenol A diglycidyl ether, bisphenol F diglycidyl ether, glycerin triglycidyl ether, pentaerythritol tetraglycidyl ether, and glycidyl ethers of phenol novolak (having an average polymerization degree of from 30 to 60); diene oxides (e.g., pentadiene dioxide and hexadiene dioxide); etc. Among these polyepoxides, polyglycidyl ethers are preferable and ethylene glycol diglycidyl ether and bisphenol A diglycidyl ether are more preferable.

The number of epoxy groups included in a molecule of a polyepoxide (C) is preferably from 2 to 8, more preferably from 2 to 6, and even more preferably from 2 to 4. The epoxy equivalence of the polyepoxide (C) is not particularly limited, but is preferably from 50 to 500, more preferably from 70 to 300 and even more preferably from 80 to 200. By using a polyepoxide having epoxy groups and/or an epoxy equivalence in the above-mentioned ranges, the resultant toner has good combination of developing property and fixing property. It is more preferable to use a polyepoxide having epoxy groups and an epoxy equivalence in the above-mentioned ranges.

The ratio (OH)/(COOH) (equivalent ratio) of a polyol to a polycarboxylic acid is preferably from 2/1 to 1/2, more preferably from 1.5/1 to 1/1 and even more preferably from 1.3/1 to 1/1.2.

It is preferable to choose proper polyols and polycarboxyl acids so that the resultant polyester has a proper molecular weight and a glass transition temperature of from 40 to 90° C.

Specific examples of the linear polyester resins (X1) include the following resins (1) to (3), but are not limited thereto:

(1) polycondensation products of a propylene oxide (2 mole) adduct of bisphenol A/terephthalic acid;

(2) polycondensation products of an ethylene oxide (4 mole) adduct of bisphenol A/a propylene oxide (2 mole) adduct of bisphenol A/terephthalic acid; and (3) polycondensation products of a propylene oxide (2 mole) adduct of bisphenol A/a propylene oxide (3 mole) adduct of bisphenol A/terephthalic acid/isophthalic acid/maleic anhydride.

Specific examples of the non-linear polyester resins include the following resins (4) to (10), but are not limited thereto:

(4) polycondensation products of an ethylene oxide (2 mole) adduct of bisphenol A/a propylene oxide (3 mole) adduct of bisphenol A/terephthalic acid/phthalic anhydride/trimellitic anhydride;

(5) polycondensation products of a propylene oxide (2 mole) adduct of bisphenol A/a propylene oxide (3 mole) adduct of bisphenol A/an ethylene oxide (2 mole) adduct of bisphenol A/a propylene oxide (5 mole) adduct of phenol novolak/terephthalic acid/maleic anhydride/dimethyl terephthalate/trimellitic anhydride;

(6) polycondensation products of an ethylene oxide (2 mole) adduct of bisphenol A/a propylene oxide (2 mole) adduct of bisphenol A/terephthalic acid/trimellitic anhydride;

(7) polycondensation products of an ethylene oxide (2 mole) adduct of bisphenol A/a propylene oxide (2 mole) adduct of bisphenol A/terephthalic acid/maleic anhydride/trimellitic anhydride;

(8) polycondensation products of a propylene oxide (2 mole) adduct of bisphenol A/a propylene oxide (3 mole) adduct of bisphenol A/terephthalic acid/isophthalic acid/maleic anhydride/trimellitic anhydride;

(9) polycondensation products of a propylene oxide (2 mole) adduct of bisphenol A/a propylene oxide (3 mole) adduct of bisphenol A/an ethylene oxide adduct of phenol novolak/isophthalic acid/trimellitic anhydride; and

(10) polycondensation products of an ethylene oxide (2 mole) adduct of bisphenol A/a propylene oxide (2 mole) adduct of bisphenol A/a propylene oxide (5 mole) adduct of phenol novolak/terephthalic acid/fumaric acid/trimellitic anhydride.

Specific examples of the modified polyester resins (Y1) include the following resins (11) to (20), but are not limited thereto:

(11) modified polyesters prepared by reacting tetramethylene glycol diglycidyl ether with a polycondensation product of a propylene oxide (2 mole) adduct of bisphenol A/an ethylene oxide (2 mole) adduct of bisphenol A/a propylene oxide (5 mole) adduct of phenol novolak/terephthalic acid/dodecenyl succinic anhydride;

(12) modified polyesters prepared by reacting ethylene glycol diglycidyl ether with a polycondensation product of a propylene oxide (2 mole) adduct of bisphenol A/a propylene oxide (3 mole) adduct of bisphenol A/an ethylene oxide (2 mole) adduct of bisphenol A/a propylene oxide (5 mole) adduct of phenol novolak/terephthalic acid/dodecenyl succinic anhydride;

(13) modified polyesters prepared by reacting bisphenol A diglycidyl ether with a polycondensation product of a propylene oxide (2 mole) adduct of bisphenol A/a propylene oxide (3 mole) adduct of bisphenol A/an ethylene oxide adduct of phenol novolak/isophthalic acid/maleic anhydride/trimellitic anhydride;

(14) modified polyesters prepared by reacting bisphenol A diglycidyl ether with a polycondensation product of a propylene oxide (2 mole) adduct of bisphenol A/a propylene oxide (3 mole) adduct of bisphenol A/an ethylene oxide (2 mole) adduct of bisphenol A/an ethylene oxide adduct of phenol novolak/terephthalic acid/isophthalic acid/trimellitic anhydride;

(15) modified polyesters prepared by reacting bisphenol A diglycidyl ether with a polycondensation product of a propylene oxide (2 mole) adduct of bisphenol A/a propylene oxide (3 mole) adduct of bisphenol A/an ethylene oxide (2 mole) adduct of bisphenol A/a propylene oxide (5 mole) adduct of phenol novolak/terephthalic acid/isophthalic acid/maleic anhydride/trimellitic anhydride;

(16) modified polyesters prepared by reacting ethylene glycol diglycidyl ether with a polycondensation product of a propylene oxide (3 mole) adduct of bisphenol A/a propylene oxide (5 mole) adduct of phenol novolak/terephthalic acid/fumaric acid/trimellitic anhydride;

(17) modified polyesters prepared by reacting tetramethylene glycol diglycidyl ether with a polycondensation product of a propylene oxide (2 mole) adduct of bisphenol A/a propylene oxide (5 mole) adduct of phenol novolak/terephthalic acid/dodecenyl succinic anhydride/trimellitic anhydride;

(18) modified polyesters prepared by reacting ethylene glycol diglycidyl ether with a polycondensation product of a propylene oxide (2 mole) adduct of bisphenol A/an ethylene oxide (2 mole) adduct of bisphenol A/an ethylene oxide adduct of phenol novolak/terephthalic acid/trimellitic anhydride;

(19) modified polyesters prepared by reacting bisphenol A diglycidyl ether with a polycondensation product of a propylene oxide (2 mole) adduct of bisphenol A/a propylene oxide (3 mole) adduct of bisphenol A/a propylene oxide (5 mole) adduct of phenol novolak/terephthalic acid/trimellitic anhydride; and

(20) modified polyesters prepared by reacting phenol novolak diglycidyl ether with a polycondensation product of a propylene oxide (2 mole) adduct of bisphenol A/an ethylene oxide (2 mole) adduct of bisphenol A/terephthalic acid/trimellitic anhydride.

The requirements for the binder resin for use in full color toners are different from those for the binder for use in monochrome toners. Since full color toner images are required to have high gloss, the binder resin for full color toners is required to have a low melt viscosity. However, the binder resin for monochrome toners is required to have a high elasticity instead of low melt viscosity because the monochrome toners are required to have a good hot offset resistance instead of high gloss.

In order to produce glossy full color images, the color toners preferably include a binder resin selected from the group consisting of linear polyester resins (X1), non-linear polyester resins (X2), modified polyester resins (Y1) and mixtures thereof. In this case, it is preferable for the binder resin to have a low melt viscosity, and therefore the component molar ratio of the polyol (H) and/or the polycarboxylic acid (J) in the binder resin is preferably controlled such that the total amount of the (H) and (J) is from 0 to 20% by mole, preferably from 0 to 15% by mole, and more preferably from 0 to 10% by mole, based on the total of the diol (G), polyol (H), dicarboxylic acid (I) and polycarboxylic acid (J).

The temperature TE of polyester resins for use in full color toners, at which the complex viscosity coefficient thereof is 100 Pa·s, is preferably from 90 to 170° C., more preferably from 100 to 165° C., and even more preferably from 105 to 150° C. When the temperature TE is not higher than 170° C., the resultant toner images have high gloss. When the temperature is not lower than 90° C., the resultant toner has good preservability.

The temperature TE of a binder resin can be determined by the following method:

(1) the binder resin is melted at 130° C. and kneaded for 30 minutes using LABP PRASTOMILL under a condition of 70 rpm in revolution, followed by cooling to prepare a block of the resin; and (2) the block is set in a dynamic viscoelasticity measuring instrument and heated to determine the relationship between temperatures and complex viscosity coefficient of the binder resin.

The content of tetrahydrofuran (THF)-insoluble components in the resins for use as the binder resin for full color toners is preferably not greater than 10% by weight, and more preferably not greater than 5% by weight, in view of the gloss of the resultant toner images.

The contents of THF-insoluble components and THF-soluble components in a resin can be determined by the following method:

(1) about 0.5 g of a sample, which is precisely weighed, is mixed with 50 ml of THF in a 200 ml of a Meyer flask with ground-in stopper;

(2) the mixture is agitated for 3 hours under reflux, followed by cooling;

(3) solid components (i.e., THF-insoluble components) therein are filtered out using a glass filter; and (4) the solid components are dried at 80° C. for 3 hours under a reduced pressure, followed by weighing of the solid components.

The content (Ci) of THF-insoluble components in the sample is determined as follows:

$$Ci(\%)=(Wi/W)\times 100$$

wherein Wi is the weight of the dried solid components and W is the weight of the sample.

The filtrate, which includes THF-soluble components, can be used for measuring the molecular weight of the resin sample.

The molecular weight of the binder resin is described below.

The polyester resins for use in the toner of the present invention preferably have a maximum peak molecular weight of from 1,000 to 30,000, preferably from 1,500 to 25,000, and more preferably from 1,800 to 20,000. When the maximum peak molecular weight is not less than 1,000, the resultant toner has good preservability and good fluidity. When the maximum peak molecular weight is not greater than 30,000, the binder resin has good pulverizability, resulting in increase of productivity of the toner.

In the present application, the maximum peak molecular weight, number average molecular weight, and weight average molecular weight of a (polyester) resin are determined by subjecting the THF-soluble components of the resin to gel permeation chromatography (GPC). The measuring conditions are as follows:

Instrument: HLC-8120 manufactured by Tosoh Corp.

Column: TSKgelGMHXL (2 pieces)

TSKgelMultiporeHXL-M (1 piece)

Measurement temperature: 40° C.

Solid content of sample solution: 0.25% THF solution

Volume of injected sample solution: 100 μl

Detector: Refractive index detector

Reference material: polystyrene.

The maximum peak molecular weight is defined as the molecular weight of the highest peak among the peaks in the molecular weight distribution curve.

The polyester resins for use in the toner of the present invention preferably have a glass transition temperature of from 40 to 90° C., more preferably from 50 to 80° C., and even more preferably from 55 to 75° C. When a polyester resin having a glass transition temperature of from 40 to 90° C., the resultant toner has good combination of preservability and low temperature fixability.

In the present application, the glass transition temperature of a (polyester) resin is measured using an instrument, DSC20 and SSC/580 from Seiko Instruments, Inc., and a method based on ASTM D3418-82 incorporated herein by reference.

The linear polyester resins (X1) are typically prepared by a method in which a mixture including a diol (G), a dicarboxylic acid (I) and a polymerization catalyst is heated to a temperature of from 180 to 260° C. under a normal pressure or a reduced pressure, to perform a condensation reaction while removing water generated, but the preparation method is not limited thereto.

The non-linear polyester resins (X2) are typically prepared by a method in which a mixture including a diol (G), a dicarboxylic acid (I), a polyol (H) and a polymerization catalyst is heated to a temperature of from 180 to 260° C. under a normal pressure or a reduced pressure, followed by reaction of the product with a polycarboxylic acid (J), to perform a condensation reaction while removing water generated, but the preparation method is not limited thereto. The polycarboxylic acid (J) can be mixed with the diol (G), dicarboxylic acid (I), polyol (H) and polymerization catalyst, to perform a reaction at the same time.

The modified polyester resins (Y1) are typically prepared by a method in which a mixture including a non-linear polyester resin (X2) and a polyepoxide (C) is heated to a temperature of from 180 to 260° C. under a normal pressure or a reduced pressure to perform an extension reaction of the polyester resin, but the preparation method is not limited thereto.

The toner of the present invention can include two or more kinds of polyester resins as the binder resin.

The toner of the present invention includes one or more kinds of polyester resins as the main binder, but other resins can also be included therein in an amount not greater than 40% by weight.

Specific examples of such resins include styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

In order that the toner have good low temperature fixability and wide fixable temperature range and produce images with proper gloss, the one or more resins included in the toner (i.e., the THF-soluble components of the resins) preferably have a number average molecular weight (Mn) of from 2,000 to 7,000, and a weight average molecular weight (Mw) of from 10,000 to 70,000.

When color images have high gloss, the color images look clear. Therefore, in order to produce clear color images, the binder resin in the color toners preferably have a number average molecular weight of from 2,000 to 5,000, and a weight average molecular weight of from 10,000 to 30,000.

The glossiness of color images is preferably from 5 to 80%. Preparation of an image (i.e., a toner layer) having such a glossiness means that the toner particles therein are almost perfectly fused with each other, and thereby light can easily pass through the toner layer or layers and is reflected from the support of the image. Therefore, the color image looks clear.

The toner of the present invention can include a wax if necessary. By including a wax in the toner, the toner has advantages such that (1) the toner particles have high cohesive force; and (2) the toner is rapidly softened when heated. However, toner including a wax tends to aggregate. However, by using a wax in combination with the polyester resins mentioned above, occurrence of the aggregation problem can be prevented.

Recently, a need exists for full color image forming apparatus having small size and low cost. Therefore the apparatus typically use an oil-less fixing device which does not have an applicator applying an oil to the fixing rollers. It is preferable for the toner used for the apparatus to include a wax therein.

The melting point of the waxes for use in the toner of the present invention is from 40 to 120° C., and preferably from 50 to 110° C. When the melting point of the wax used is too low, the hot offset resistance and preservability of the resultant toner deteriorate. In contrast, when the melting point is too high, the resultant toner tends to have a poor low temperature fixability. In the present application, the melting point of a wax can be determined by a method using a differential scanning calorimeter (DSC), in which few milligrams of a sample are heated at a constant temperature rising speed (for example, 10° C./min) to determine the temperature at which a peak caused by melting of the sample is observed.

Specific examples of the waxes for use in the toner of the present invention include solid paraffin waxes, microcrystalline waxes, rice waxes, aliphatic amide waxes, fatty acid based waxes, aliphatic monoketones, fatty acid metal salt based waxes, fatty acid ester based waxes, partially-saponified fatty acid ester based waxes, silicone varnishes, higher alcohols, carnauba waxes, etc. In addition, low molecular weight polyolefin such as polyethylene and polypropylene can also be used as the wax.

The toner of the present invention can include a charge controlling agent, a release agent and an external additive if desired.

Any known charge controlling agents can be used for the toner of the present invention to control the charge properties of the toner.

Specific examples of the charge controlling agent include Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc.

Specific examples of the marketed products of the charge controlling agents include BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84, E304 and X-11 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt) and TN-105 (metal complex of salicylic acid), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge controlling agent in the toner is determined depending on the binder resin used, the content of the additives included in the toner and the manufacturing method of the toner, but is generally from 0.1 to 10 parts by weight, and preferably from 0.3 to 5 parts by weight, per 100 parts by weight of the binder resin. When the content is too high, the toner has too large a charge quantity, and thereby the attraction between the toner and the developing roller used increases, resulting in deterioration of fluidity of the toner and image density of the resultant images.

The toner of the present invention can include an particulate inorganic material as an external additive. Suitable inorganic materials include particulate inorganic materials having a primary particle diameter of from 5 nm to 2 μm, and more preferably from 5 nm to 500 nm. The surface area of the inorganic particulate materials is preferably from 20 to 500 $m^2/g$ when measured by a BET method.

The content of the particulate inorganic material is preferably from 0.01% to 5.0% by weight, and more preferably from 0.01% to 2.0% by weight, based on the total weight of the toner.

Specific examples of such particulate inorganic materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Particles of a polymer such as polystyrene, and copolymers of methacrylates and/or acrylates, which are prepared by a polymerization method such as soap-free emulsion polymerization methods, suspension polymerization methods and dispersion polymerization methods; particles of a polymer such as silicone, benzoguanamine and nylon, which are prepared by a polymerization method such as polycondensation methods; and particles of a thermosetting resin can also be used as the external additive of the toner of the present invention.

The external additive used for the toner of the present invention is preferably subjected to a hydrophobizing treatment to prevent deterioration of the fluidity and charge properties of the resultant toner particularly under high humidity conditions. Suitable hydrophobizing agents for use in the hydrophobizing treatment include silicone oils, silane coupling agents, silylation agents, silane coupling agents having a fluorinated alkyl group, organic titanate coupling agents, aluminum coupling agents, etc.

In addition, the toner preferably includes a cleanability improving agent which can impart good cleaning property to the toner such that the toner remaining on the surface of an image bearing member such as a photoreceptor even after a toner image is transferred can be easily removed. Specific examples of such a cleanability improving agent include fatty acids and their metal salts such as stearic acid, zinc stearate, and calcium stearate; and particulate polymers such as polymethyl methacrylate and polystyrene, which are manufactured by a method such as soap-free emulsion polymerization methods.

Particulate resins having a relatively narrow particle diameter distribution and a volume average particle diameter of from 0.01 μm to 1 μm are preferably used as the cleanability improving agent.

The resins, charge controlling agents, release agents, and external additives for use in the color toner of the present invention are preferably colorless, or have a white or pale color, while being transparent or semi-transparent.

The toner of the present invention includes a colorant. Suitable materials for use as the colorant include known dyes and pigments.

Specific examples of the dyes and pigments include carbon black, Nigrosine dyes, black iron oxide, Naphthol Yellow S(C.I. 10316), Hansa Yellow 10G (C.I. 11710), Hansa Yellow 5G (C.I. 11660), Hansa Yellow G (C.I. 11680), Cadmium Yellow, yellow iron oxide, loess, chrome yellow, Titan Yellow, polyazo yellow, Oil Yellow, Hansa Yellow GR (C.I. 11730), Hansa Yellow A (C.I. 11735), Hansa Yellow RN (C.I. 11740), Hansa Yellow R (C.I. 12710), Pigment Yellow L (C.I. 12720), Benzidine Yellow G (C.I. 21095), Benzidine Yellow GR (C.I. 21100), Permanent Yellow NCG (C.I. 20040), Vulcan Fast Yellow 5G (C.I. 21220), Vulcan Fast Yellow R (C.I. 21135), Tartrazine Lake, Quinoline Yellow Lake, Anthrazane Yellow BGL (C.I. 60520), isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red F2R(C.I. 12310), Permanent Red F4R(C.I. 12335), Permanent Red FRL (C.I. 12440), Permanent Red FRLL (C.I. 12460), Permanent Red F4RH(C.I. 12420), Fast Scarlet VD, Vulcan Fast Rubine B (C.I. 12320), Brilliant Scarlet G, Lithol Rubine GX (C.I. 12825), Permanent Red F5R, Brilliant Carmine 6B, Pigment Scarlet 3B, Bordeaux 5B, Toluidine Maroon, Permanent Bordeaux F2K (C.I. 12170), Helio Bordeaux BL (C.I. 14830), Bordeaux 10B, Bon Maroon Light (CI. 15825), Bon Maroon Medium (C.I. 15880), Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue RS (C.I. 69800), Indanthrene Blue BC (C.I. 69825), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 0.1 to 50 parts by weight per 100 part by weight of the binder resin included in the toner.

The toner of the present invention generally has a volume average particle diameter of from 5 to 15 μm. However, when it is desired to produce high definition images, the particle diameter of the toner is preferably as small as possible. Specifically, the toner preferably has a volume average particle diameter (D4) of from 3.0 to 7.5 μm, and more preferably from 4.0 to 7.0 μm.

The particle diameters Dv and Dn of the toner of the present invention can be measured by an instrument such as COULTER COUNTER MULTISIZER II or III (manufactured by Beckman Coulter, Inc.) using an aperture having an opening with 50 μm. The method for measuring average particle diameters Dv and Dn is as follows:

(1) a surfactant serving as a dispersant, preferably 0.1 to 5 ml of a 1% aqueous solution of an alkylbenzenesulfonic acid salt, is added to an electrolyte such as 1% aqueous solution of first class NaCl or ISOTON-II manufactured by Coulter Electronics, Inc.;
(2) 2 to 20 mg of a sample to be measured is added into the mixture;
(3) the mixture is subjected to an ultrasonic dispersion treatment for about 1 to 3 minutes; and
(4) the volume average particle diameter (Dv) and number average particle diameter (Dn) of the sample are measured using the instrument mentioned above and an aperture of 100 μm.

Then the image forming apparatus of the present invention, which produce images using the toner of the present invention, will be explained referring to drawings.

FIG. 1 is a schematic view illustrating an embodiment of the electrophotographic image forming apparatus of the present invention. The below-mentioned modified versions can also be included in the scope of the present invention.

In FIG. 1, numeral 1 denotes a photoreceptor serving as an image bearing member.

The photoreceptor 1 has a drum form, but photoreceptors having a form such as sheet-form and endless belt-form can also be used.

Around the photoreceptor 1, a quenching lamp 10 configured to decrease charges remaining on the photoreceptor 1, a charger 2 configured to charge the photoreceptor 1, an imagewise light irradiator 3 configured to irradiate the photoreceptor 1 with imagewise light to form an electrostatic latent image on the photoreceptor 1, a developing device 4 configured to develop the latent image with a developer 5 including the toner of the present invention to form a toner image on the photoreceptor 1, and a cleaning unit 7 including a cleaning blade configured to clean the surface of the photoreceptor 1, are arranged while contacting or being set closely to the photoreceptor 1. The toner image formed on the photoreceptor 1 is transferred on a receiving paper 8 by a transfer device 6. The toner image on the receiving paper 8 is fixed thereon by a fixing device 9.

The developing device 4 includes a developing roller 41 serving as a developer bearing member and a developing blade 100 configured to form a uniform thin developer layer on the surface of the developing roller 41. The electrostatic latent image formed on the photoreceptor 1 is developed with the toner in the developer layer formed on the surface of the developing roller 41.

As the charger 2, any known chargers such as corotrons, scorotrons, solid state chargers, and roller chargers can be used. Among the chargers, contact chargers and short-range chargers are preferably used because of consuming low power. In particularly, a short-range charger which charges a photoreceptor while a proper gap is formed between the charger and the surface of the photoreceptor is more preferably used.

As the transfer device 6, the above-mentioned known chargers can be used. Among the chargers, a combination of a transfer charger and a separating charger is preferably used.

Suitable light sources for use in the imagewise light irradiator 3 and the quenching lamp 10 include fluorescent lamps, tungsten lamps, halogen lamps, mercury lamps, sodium lamps, light emitting diodes (LEDs), laser diodes (LDs), light sources using electroluminescence (EL), and the like. In addition, in order to obtain light having a desired wave length range, filters such as sharp-cut filters, band pass filters, near-infrared cutting filters, dichroic filters, interference filters, color temperature converting filters and the like can be used.

When the toner image formed on the photoreceptor 1 by the developing device 4 is transferred onto the receiving paper 8, all of the toner image are not transferred on the receiving paper 8, and toner particles remain on the surface of the photoreceptor 1. The residual toner is removed from the photoreceptor 1 by the cleaner 7. Suitable cleaners for use as the cleaner 7 include cleaning blades made of a rubber, fur blushes and mag-fur blushes.

When the photoreceptor 1 which is previously charged positively (or negatively) is exposed to imagewise light, an electrostatic latent image having a positive (or negative) charge is formed on the photoreceptor 1. When the latent image having a positive (or negative) charge is developed with a toner having a negative (or positive) charge, a positive image can be obtained. In contrast, when the latent image having a positive (negative) charge is developed with a toner having a positive (negative) charge, a negative image (i.e., a reversal image) can be obtained.

Figure 2:
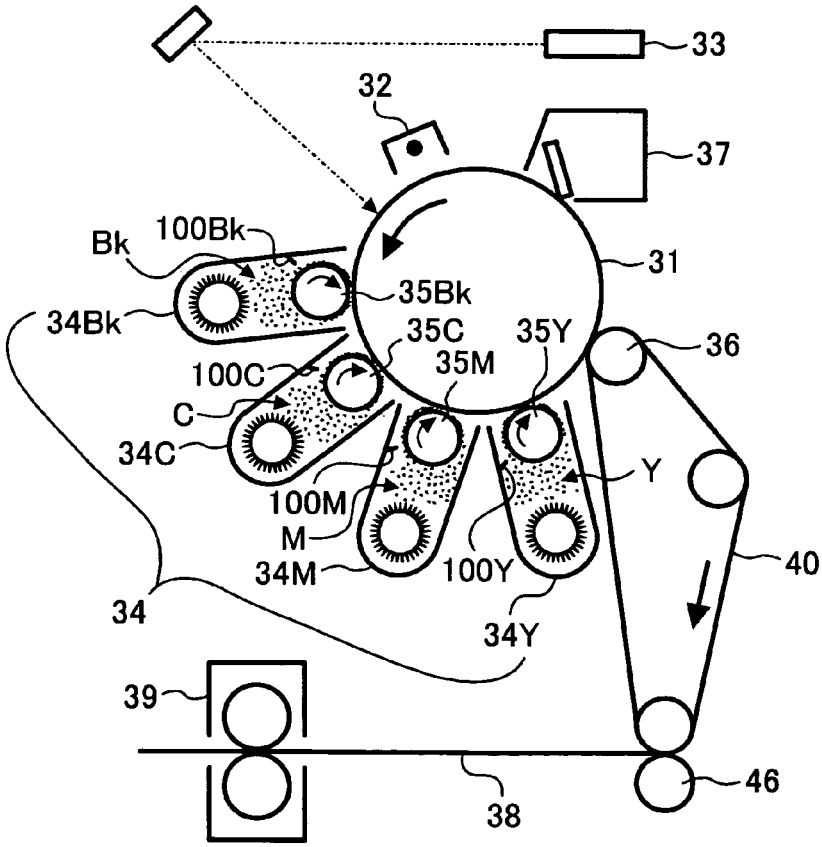
FIG. 2 is a schematic view illustrating another embodiment of the image forming apparatus of the present invention, which includes plural developing devices.

FIG. 2 illustrates another embodiment of the image forming apparatus of the present invention, which can produce full color images. Referring to FIG. 2, the image forming apparatus has a photoreceptor 31. Around the photoreceptor 31, a charger 32, an imagewise light irradiator 33, an image developing unit 34 having a black image developer 34Bk, a cyan image developer 34C, a magenta image developer 34M and a yellow image developer 34Y, an intermediate transfer belt 40 serving as an intermediate transfer medium, and a cleaner 37 are arranged.

The image developers 34Bk, 34C, 34M and 34Y can be independently controlled, and each of the image developers is independently driven when desired. In each of the image developers, an electrostatic latent image formed on the photoreceptor 31 is developed with a toner layer formed on a developing roller 35Bk, 35C, 35M or 35Y by a developing blade 100Bk, 100C, 100m or 100Y, respectively. Characters Bk, C, M and Y denote black, cyan, magenta and yellow color toners of the present invention, respectively. The color toner images thus formed on the photoreceptor 31 are transferred onto the intermediate transfer belt 40 by a first transfer device 36. In this case, it is preferable to apply a voltage to the first transfer device 36 to place the toner image in an electric field. The intermediate transfer belt 40 is brought into contact with the photoreceptor 31 by the first transfer device 36 only when color toner images on the photoreceptor 31 are transferred thereto. The color toner images are overlaid on the intermediate transfer belt 40, resulting in formation of a full color toner image. The full color toner image is transferred onto a receiving material 38 by a second transfer device 46, and then fixed on the receiving material 38 by a fixing device 39. The second transfer device 46 is brought into contact with the intermediate transfer belt 40 only when the transfer operation is performed.

In an image forming apparatus having a drum-form transfer device, color toner images are transferred onto a receiving material electrostatically attached to the transfer drum.

Therefore, an image cannot be formed on a thick paper. However, in the image forming apparatus as illustrated in FIG. 2, each toner image is formed on the intermediate transfer belt and the overlaid toner images are transferred onto a receiving material while applying a pressure thereto. Therefore, an image can be formed on any kinds of receiving materials. The image forming method using an intermediate transfer medium can also be applied to the image forming apparatus as illustrated in FIG. 1.

Figure 3:
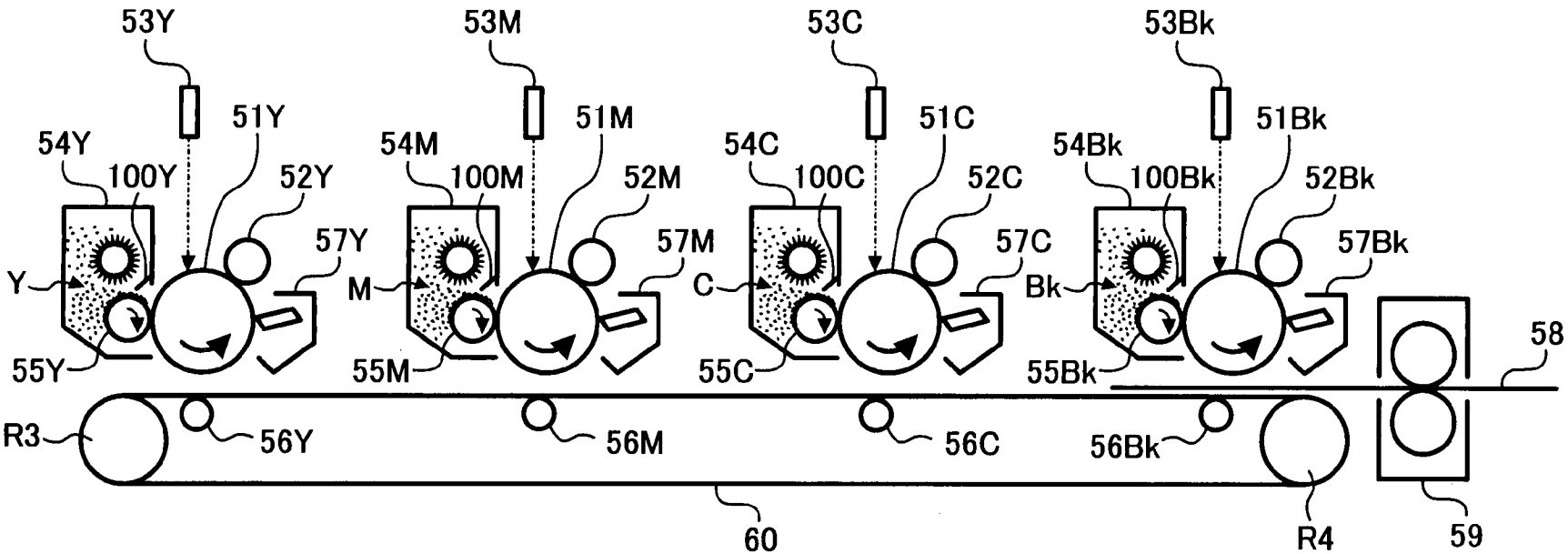
FIG. 3 is a schematic view illustrating yet another embodiment of the image forming apparatus of the present invention, which includes four image bearing members and respective developing devices.

FIG. 3 illustrates yet another embodiment of the image forming apparatus of the present invention.

The image forming apparatus has four color image forming sections, i.e., yellow, magenta, cyan and black image forming sections. The image forming sections include respective photoreceptors 51Y, 51M, 51C and 51Bk.

Around each of the photoreceptors 51Y, 51M, 51C and 51Bk, a charger (52Y, 52M, 52C or 52Bk), an imagewise light irradiator (53Y, 53M, 53C or 53Bk), an image developer (54Y, 54M, 54C or 54Bk), and a cleaner (57Y, 57M, 57C or 57Bk) are arranged. Each image developer (54Y, 54M, 54C or 54Bk) includes a developing roller (55Y, 55M, 55C or 55Bk) and a developing blade (100Y, 100M, 100C or 100Bk). In addition, a feed/transfer belt 60, which is arranged below the image forming sections, is tightly stretched by rollers R3 and R4. The feed/transfer belt 60 is attached to or detached from the photoreceptors by transfer devices 56Y, 56M, 56C and 56Bk to transfer toner images from the photoreceptors to a receiving material 58. The resultant color toner image is fixed by a fixing device 59.

The tandem-type image forming apparatus illustrated in FIG. 3 has four photoreceptors for forming four color images, and color toner images which can be formed in parallel can be transferred onto the receiving material 58. Therefore, the image forming apparatus can form full color images at a high speed.

Each of the image developer (54Y, 54M, 54C or 54Bk) also includes the blade (10Y, 100M, 100C or 100Bk) and a toner (Y, M, C or Bk). The toners are the toner of the present invention.

The above-mentioned image forming unit may be fixedly set in a copier, a facsimile or a printer. However, the image forming unit may be set therein as a process cartridge. The process cartridge means an image forming unit which includes at least a developing device including the toner of the present invention (when a one component developing method is used) or a developer including the toner of the present invention (when a two component developing method is used) and a housing. The process cartridge optionally includes one or more devices selected from the group consisting of an image bearing member (such as photoreceptors), a charger, an image developer and a cleaner.

Figure 4:
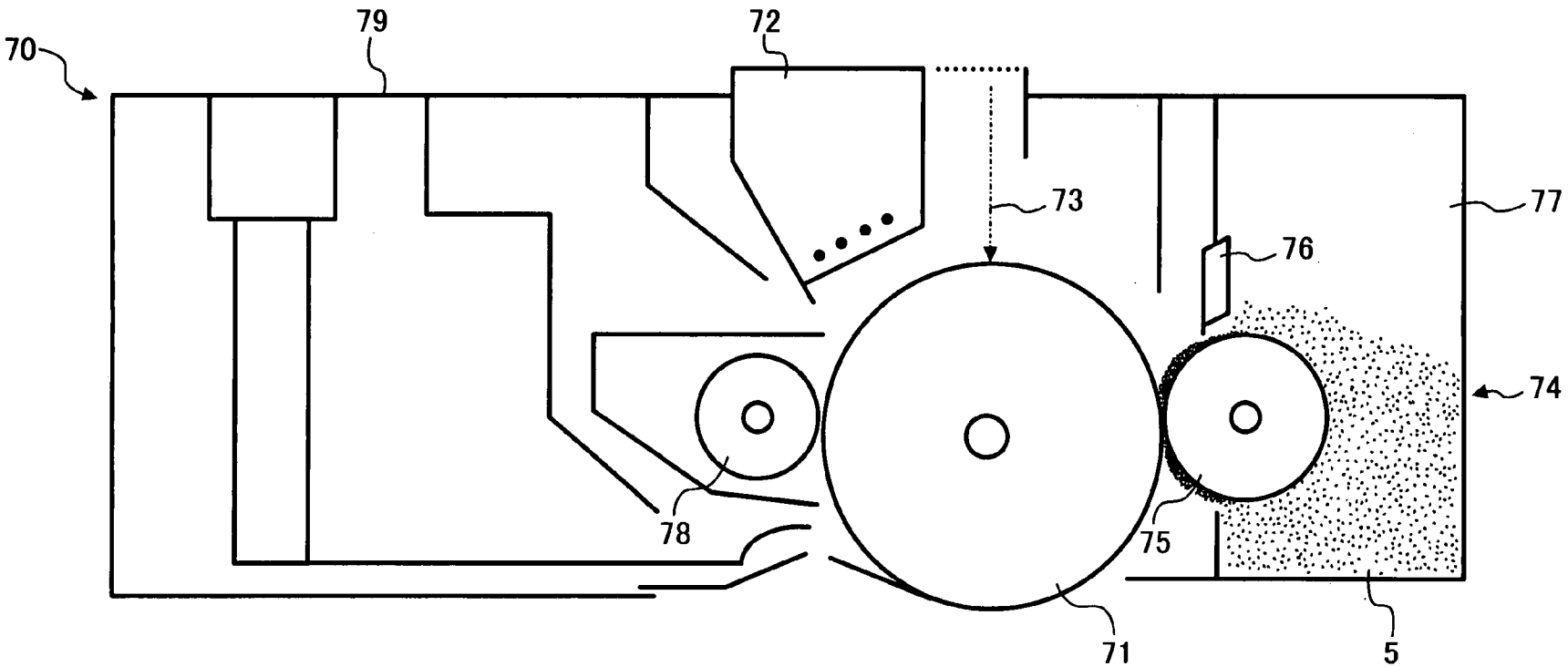
FIG. 4 is a schematic view illustrating an embodiment of the process cartridge of the present invention.

FIG. 4 is a schematic view illustrating an embodiment of the process cartridge of the present invention. In FIG. 4, a process cartridge 70 includes a photoreceptor 71 serving as an electrostatic latent image bearing member, a charger 72 configured to charge the photoreceptor 71, a developing device 74 configured to develop the latent image with the developer 5 including the toner of the present invention, and a cleaning brush 78 configured to clean the surface of the photoreceptor 71. Numeral 73 denotes an imagewise light beam configured to irradiate the photoreceptor 71 to form an electrostatic latent image on the photoreceptor 71. Numeral 79 denotes a housing of the process cartridge.

The developing device 74 includes a developer container 77 configured to contain the developer 5 including the toner of the present invention, a developing roller 75 configured to develop the latent image on the surface of the photoreceptor 71 and a developer blade 76 configured to form a uniform thin layer of the developer 5 on the developing roller 75.

The structure of the process cartridge of the present invention is not limited to that illustrated in FIG. 4.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Synthesis of a Linear Polyester Resin (X1-1)

In a reaction vessel equipped with a condenser, a stirrer and a nitrogen gas feeding pipe, 395 parts of an ethylene oxide (2 mole) adduct of bisphenol A, 285 parts of a propylene oxide (2 mole) adduct of bisphenol A, 265 parts of terephthalic acid, 65 parts of fumaric acid and 2 parts of potassium salt of titanyl oxalate which serves as a polycondensation catalyst were mixed. Then the mixture was reacted for 10 hours at 220° C. under a nitrogen gas flow while the water generated as a result of the polycondensation reaction was distilled out of the system. Further, the reaction was continued under a reduced pressure of from 5 to 20 mmHg. When the reaction product had an acid value of 18 mgKOH/g, the reaction product was taken out of the vessel, followed by cooling to room temperature and crushing. Thus, a linear polyester resin (X1-1) was prepared.

The linear polyester resin (X1-1) included no THF-insoluble components, and had an acid value of 28 mgKOH/g, a hydroxyl value of 25 mgKOH/g, a glass transition temperature of 58° C., a number average molecular weight of 3,400, a weight average molecular weight of 14, 300 and a maximum peak molecular weight of 7,400.

Synthesis of Non-linear Polyester Resin (X2-1)

In a reaction vessel equipped with a condenser, a stirrer and a nitrogen gas feeding pipe, 350 parts of an ethylene oxide (2 mole) adduct of bisphenol A, 326 parts of a propylene oxide (3 mole) adduct of bisphenol A, 278 parts of terephthalic acid, 40 parts of phthalic anhydride and 1.5 parts of potassium salt of titanyl oxalate which serves as a polycondensation catalyst were mixed. Then the mixture was reacted for 10 hours at 230° C. under a nitrogen gas flow while the water generated as a result of the polycondensation reaction was distilled out of the system. Further, the reaction was continued under a reduced pressure of from 5 to 20 mmHg. When the reaction product had an acid value not greater than 2 mgKOH/g, the reaction product was cooled to 180° C. Then 62 parts of trimellitic anhydride were added thereto to perform a reaction for 2 hours under a normal pressure. Then the reaction product was taken out of the vessel, followed by cooling to room temperature and crushing. Thus, a non-linear polyester resin (X2-1) was prepared.

The non-linear polyester resin (X2-1) included no THF-insoluble components, and had an acid value of 36 mgKOH/g, a hydroxyl value of 17 mgKOH/g, a glass transition temperature of 69° C., a number average molecular weight of 3,810, a weight average molecular weight of 20,300 and a maximum peak molecular weight of 11,400.

Preparation of Binder Resin

Eight hundred (800) parts of the linear polyester resin (X1-1) and 200 parts of the non-linear polyester resin (X2-1) were melted and mixed for 3 minutes using a continuous kneader having a jacket heated to 150° C. The melted resin mixture was cooled using a steel belt cooling machine so that the resin mixture was cooled to 30° C. in four minutes, followed by pulverizing. Thus, a toner binder (TB1) was prepared.

Preparation of Toners

The following toners were prepared using the toner binder (TB1).

Formula of Cyan Toner (C1-1)

| | |
|---|---|
| Toner binder (TB1) | 100 parts |
| Cyan pigment (pigment blue 15-3) | 3.5 parts |
| Charge controlling agent (E-84 from Orient Chemical Industries Co., Ltd.) | 1 part |

Formula of Magenta Toner (M1-1)

| | |
|---|---|
| Toner binder (TB1) | 100 parts |
| Magenta pigment (pigment red 122) | 7 parts |
| Charge controlling agent (E-84 from Orient Chemical Industries Co., Ltd.) | 1 part |

Formula of Yellow Toner (Y1-1)

| | |
|---|---|
| Toner binder (TB1) | 100 parts |
| Yellow pigment (pigment yellow 180) | 7 parts |
| Charge controlling agent (E-84 from Orient Chemical Industries Co., Ltd.) | 1 part |

Formula of Black Toner (BK1-1)

| | |
|---|---|
| Toner binder (TB1) | 100 parts |
| Black pigment (carbon black) | 4 parts |
| Charge controlling agent (E-84 from Orient Chemical Industries Co., Ltd.) | 1 part |

The toners were prepared as follows. At first, the pigment, the binder resin and pure water were mixed in a weight ratio of 1:1:0.5, and the mixture was kneaded with a two roll mill. The kneading was performed at 70° C., and then the temperature of the rolls was raised to 120° C. to remove water therefrom. Thus, a masterbatch was prepared.

Then the masterbatch was mixed with the residue of the binder resin and the charge controlling agent using a Henschel mixer (FM10B from Mitsui Miike Machinery Co., Ltd.). Further, the mixture was kneaded with a biaxial kneader (PCM-30 from Ikegai Corp.). Then the kneaded mixture was pulverized with a supersonic jet air pulverizer (LABJET from Nippon Pneumatic Mfg. Co., Ltd.), followed by classification using an air flow classifier (MDS-I from Nippon Pneumatic Mfg. Co., Ltd.). Thus, toner particles having a volume average particle diameter of about 7 μm were prepared with respect to the four color toner.

Then 1.0 part of a silica (H-2000 from Clariant Japan K.K.) was mixed with 100 parts of the toner particles. Thus, four toners (Y1-1, M1-1, C1-1 and BK1-1) which do not include a wax were prepared.

In addition, the procedure for preparation of the four toners was repeated except that the formulae of the toners were changed as follows.

Formula of Cyan Toner (C1-2)

| | |
|---|---|
| Toner binder (TB1) | 100 parts |
| Cyan pigment (pigment blue 15-3) | 3.5 parts |
| Wax (Carnauba wax from which free fatty acids are removed) | 5 parts |
| Charge controlling agent (E-84 from Orient Chemical Industries Co., Ltd.) | 1 part |

Formula of Magenta Toner (M1-2)

| | |
|---|---|
| Toner binder (TB1) | 100 parts |
| Magenta pigment (pigment red 122) | 7 parts |
| Wax (Carnauba wax from which free fatty acids are removed) | 5 parts |
| Charge controlling agent (E-84 from Orient Chemical Industries Co., Ltd.) | 1 part |

Formula of Yellow Toner (Y1-2)

| | |
|---|---|
| Toner binder (TB1) | 100 parts |
| Yellow pigment (pigment yellow 180) | 7 parts |
| Wax (Carnauba wax from which free fatty acids are removed) | 5 parts |
| Charge controlling agent (E-84 from Orient Chemical Industries Co., Ltd.) | 1 part |

Formula of Black Toner (BK1-2)

| | |
|---|---|
| Toner binder (TB1) | 100 parts |
| Black pigment (carbon black) | 4 parts |
| Wax (Carnauba wax from which free fatty acids are removed) | 5 parts |
| Charge controlling agent (E-84 from Orient Chemical Industries Co., Ltd.) | 1 part |

When these toners were prepared, the wax was added when the masterbatch, the residue of the binder resin and the charge controlling agent were mixed.

Example 2

Synthesis of a Linear Polyester Resin (X1-2)

In a reaction vessel equipped with a condenser, a stirrer and a nitrogen gas feeding pipe, 430 parts of a propylene oxide (2 mole) adduct of bisphenol A, 300 parts of a propylene oxide (3 mole) adduct of bisphenol A, 257 parts of terephthalic acid, 65 parts of isophthalic acid, 10 parts of maleic anhydride and 2 parts of potassium salt of titanyl oxalate which serves as a polycondensation catalyst were mixed. Then the mixture was reacted for 10 hours at 220° C. under a nitrogen gas flow while the water generated as a result of the polycondensation reaction was distilled out of the system. Further, the reaction was continued under a reduced pressure of from 5 to 20 mmHg. When the reaction product had an acid value of 5 mgKOH/g, the reaction product was taken out of the vessel, followed by cooling to room temperature and crushing. Thus, a linear polyester resin (X1-2) was prepared.

The linear polyester resin (X1-2) included no THF—insoluble components, and had an acid value of 8 mgKOH/g, a hydroxyl value of 12 mgKOH/g, a glass transition temperature of 59° C., a number average molecular weight of 6,890, a weight average molecular weight of 32,100 and a maximum peak molecular weight of 19,800.

This polyester resin (X1-2) was used as the binder resin (TB2).

Preparation of Toners

The procedure for preparation of the toners in Example 1 was repeated except that the binder resin was changed to the binder resin (TB2) to prepare toners (Y2-1, M2-1, C1-2 and BK2-1) which do not include a wax, and toners (Y2-2, M2-2, C2-2 and BK2-2) each of which includes the carnauba wax.

Example 3

Synthesis of Linear Polyester Resin (X1-3)

The procedure for preparation of the linear polyester resin (X1-1) in Example 1 was repeated except that the polycondensation catalyst was changed to 2 parts of titanium terephthalate. Thus, a linear polyester resin (X1-3) was prepared.

The linear polyester resin (X1-3) included no THF—insoluble components, and had an acid value of 27 mgKOH/g, a hydroxyl value of 24 mgKOH/g, a glass transition temperature of 58° C., a number average molecular weight of 3,500, a weight average molecular weight of 14,500 and a maximum peak molecular weight of 7,500.

Synthesis of Non-linear Polyester Resin (X2-3)

The procedure for preparation of the non-linear polyester resin (X2-1) was repeated except that the polycondensation catalyst was changed to 1.5 parts of titanium terephthalate. Thus, a non-linear polyester resin (X2-3) was prepared.

The non-linear polyester resin (X2-3) included no THF-insoluble components, and had an acid value of 33 mgKOH/g, a hydroxyl value of 15 mgKOH/g, a glass transition temperature of 69° C., a number average molecular weight of 4,130, a weight average molecular weight of 21,500 and a maximum peak molecular weight of 11,830.

Preparation of Toner Binder Resin (TB-3)

Eight hundred (800) parts of a powder of the polyester resin (X1-3) and 200 parts of a powder of the polyester resin (X2-3) were mixed for 5 minutes using a Henschel mixer to prepare a toner binder resin (TB3).

Preparation of Toner

The procedure for preparation of the toners in Example 1 was repeated except that the binder resin was changed to the toner binder resin (TB3) to prepare toners (Y3-1, M3-1, C3-1 and BK3-1) which do not include a wax, and toners (Y3-2, M3-2, C3-2 and BK3-2) each of which includes the carnauba wax.

Example 4

Synthesis of Linear Polyester Resin (X1-4)

The procedure for preparation of the linear polyester resin (X1-2) in Example 2 was repeated except that the catalyst was changed to 2 parts of titanium terephthalate.

The linear polyester resin (X1-4) included no THF—insoluble components, and had an acid value of 7 mgKOH/g, a hydroxyl value of 11 mgKOH/g, a glass transition temperature of 59° C., a number average molecular weight of 7,010, a weight average molecular weight of 33,200 and a maximum peak molecular weight of 20,100.

This polyester resin (X1-4) was used as a toner binder resin (TB4).

Preparation of Toner

The procedure for preparation of the toners in Example 1 was repeated except that the binder resin was changed to the toner binder resin (TB4) to prepare toners (Y4-1, M4-1, C4-1 and BK4-1) which do not include a wax, and toners (Y4-2, M4-2, C4-2 and BK4-2) each of which includes the carnauba wax.

Example 5

The procedure for preparation of the toners in Example 1 was repeated except that the volume average particle diameter of the toner was changed to about 5 μm by changing the pulverization conditions. Thus, toners (Y1-1-5, M1-1-5, $C_{1-1}$-5 and BK1-1-5) which do not include a wax, and toners (Y1-2-5, M1-2-5, C1-2-5 and BK1-2-5) each of which includes the carnauba wax.

Example 6

The procedure for preparation of the toners in Example 1 was repeated except that the volume average particle diameter of the toner was changed to about 9 μm by changing the pulverization conditions. Thus, toners (Y1-1-9, M1-1-9, C1-1-9 and BK1-1-9) which do not include a wax, and toners (Y1-2-9, M1-2-9, C1-2-9 and BK1-2-9) each of which includes the carnauba wax.

Comparative Example 1

Synthesis of Linear Polyester Resin (X1-5)

The procedure for preparation of the linear polyester resin (X1-1) in Example 1 was repeated except that the catalyst was changed to 2 parts of dibutyltin oxide.

The thus prepared linear polyester resin (X1-5) included no THF-insoluble components, and had an acid value of 28 mgKOH/g, a hydroxyl value of 25 mgKOH/g, a glass transition temperature of 58° C., a number average molecular weight of 3,300, a weight average molecular weight of 14,000 and a maximum peak molecular weight of 7,300.

Synthesis of Non-linear Polyester Resin (X2-5)

The procedure for preparation of the non-linear polyester resin (X2-1) in Example 1 was repeated except that the catalyst was changed to 1.5 parts of dibutyltin oxide.

The thus prepared non-linear polyester resin (X2-5) included no THF-insoluble components, and had an acid value of 34 mgKOH/g, a hydroxyl value of 16 mgKOH/g, a glass transition temperature of 69° C., a number average molecular weight of 4,050, a weight average molecular weight of 20,500 and a maximum peak molecular weight of 11,800.

Preparation of Toner Binder (TB5)

Eight hundred (800) parts of a powder of the linear polyester resin (X1-5) and 200 parts of a powder of the non-linear polyester resin (X2-5) were mixed for 5 minutes using a Henschel mixer to prepare a toner binder resin (TB5).

Preparation of Toners

The procedure for preparation of the toners in Example 1 was repeated except that the binder resin was changed to the toner binder resin (TB5) to prepare toners (Y5-1, M5-1, C5-1 and BK5-1) which do not include a wax, and toners (Y5-2, M5-2, C5-2 and BK5-2) each of which includes the carnauba wax.

Comparative Example 2

Synthesis of Linear Polyester Resin (X1-6)

The procedure for preparation of the linear polyester resin (X1-2) in Example 2 was repeated except that the catalyst was changed to 2 parts of dioctyltin oxide.

The thus prepared linear polyester resin (X1-6) included no THF-insoluble components, and had an acid value of 8 mgKOH/g, a hydroxyl value of 12 mgKOH/g, a glass transition temperature of 59° C., a number average molecular weight of 6,900, a weight average molecular weight of 32,800 and a maximum peak molecular weight of 19,900.

This linear polyester resin (X1-6) was used as a toner binder resin (TB6).

Preparation of Toner

The procedure for preparation of the toners in Example 1 was repeated except that the binder resin was changed to the toner binder resin (TB6) to prepare toners (Y6-1, M6-1, C6-1 and BK6-1) which do not include a wax, and toners (Y6-2, M6-2, C6-2 and BK6-2) each of which includes the carnauba wax.

Comparative Example 3

The procedure for preparation of the toners in Comparative Example 1 was repeated except that the volume average particle diameter of the toner was changed to about 5 μm by changing the pulverization conditions. Thus, toners (Y5-1-5, M5-1-5, C5-5 and BK5-1-5) which do not include a wax, and toners (Y5-2-5, M5-2-5, C5-2-5 and BK5-2-5) each of which includes the carnauba wax.

Comparative Example 4

The procedure for preparation of the toners in Comparative Example 1 was repeated except that the volume average particle diameter of the toner was changed to about 9 μm by changing the pulverization conditions. Thus, toners (Y5-1-9, M5-1-9, C5-2-9 and BK5-1-9) which do not include a wax, and toners (Y5-2-9, M5-2-9, C5-2-9 and BK5-2-9) each of which includes the carnauba wax.

Evaluation of Toners

1. Evaluation of Two Component Developers

Each of the color toners was mixed with a carrier to prepare two component developers. Thus, 20 sets of color developers were prepared. Each of the sets of color developers was set in a color laser printer IPSIO CX 8200 from Ricoh Co., Ltd., which includes a fixing device in which an oil is applied to the fixing rollers. When the toners including a wax were evaluated, the fixing device was was modified so as to be an oil-less fixing device.

Then a running test in which 5,000 copies of a full color image having an A4 size and constituted of yellow, magenta, cyan and black color images each having an image area proportion of 5% are continuously produced was performed. After the running test, two monochrome solid images with A3 size of each of yellow, magenta, cyan and black colors were produced to determine the number of aggregated toner particles included in the solid images. In addition, the glossiness of the solid images was also measured using an instrument MURAKAMI-style gloss meter TAPPI T480om-90 wherein the reflection angle is 60°.

2. Evaluation of One Component Developers

Each of the sets of color toners was set in a laser color printer IPSIO COLOR 6000 from Ricoh Co., Ltd. which includes a fixing device in which an oil is applied to the fixing rollers. When the toners including a wax were evaluated, the fixing device was modified so as to be an oil-less fixing device.

Then a running test in which 5,000 copies of a full color image having an A4 size and constituted of yellow, magenta, cyan and black color images each having an image area proportion of 5% are continuously produced was performed. After the running test, monochrome solid images with A4 size of each of yellow, magenta, cyan and black colors were produced to determine the number of white streaks present in the solid images.

In addition, the glossiness of the solid images was also measured using the instrument mentioned above.

The results are shown in Table 1. In addition, the volume average particle diameter (actual measurement values) of the toners is also shown in Table 1.

TABLE 1

| | | Two component developer | | One component developer | | Volume | |
|---|---|---|---|---|---|---|---|
| | Toner | Number of aggregate (pieces) | Glossiness (%) | Number of white streaks (pieces) | Glossiness (%) | average particle diameter (μm) | Inclusion of wax |
| Ex. 1 | Y1-1 | 0 | 14.5 | 0 | 16.2 | 6.8 | No |
| | M1-1 | 0 | 12.3 | 0 | 14.3 | 7.0 | |
| | C1-1 | 0 | 13.2 | 0 | 13.2 | 6.9 | |

TABLE 1-continued

| | Toner | Two component developer: Number of aggregate (pieces) | Two component developer: Glossiness (%) | One component developer: Number of white streaks (pieces) | One component developer: Glossiness (%) | Volume average particle diameter (μm) | Inclusion of wax |
|---|---|---|---|---|---|---|---|
| | BK1-1 | 0 | 11.8 | 0 | 14.4 | 6.7 | |
| | Y1-2 | 0 | 16.7 | 0 | 18.3 | 7.2 | Yes |
| | M1-2 | 0 | 15.3 | 0 | 16.7 | 7.3 | |
| | C1-2 | 0 | 15.0 | 0 | 16.6 | 7.1 | |
| | BK1-2 | 0 | 16.1 | 0 | 15.3 | 7.0 | |
| Ex. 2 | Y2-1 | 0 | 1.1 | 0 | 1.3 | 6.9 | No |
| | M2-1 | 0 | 1.2 | 0 | 1.0 | 6.7 | |
| | C2-1 | 0 | 1.1 | 0 | 1.2 | 7.1 | |
| | BK2-1 | 0 | 1.2 | 0 | 1.0 | 7.0 | |
| | Y2-2 | 0 | 0.7 | 0 | 0.9 | 7.0 | Yes |
| | M2-2 | 0 | 0.8 | 0 | 1.0 | 6.9 | |
| | C2-2 | 0 | 0.9 | 0 | 1.1 | 6.9 | |
| | BK2-2 | 0 | 0.7 | 0 | 0.9 | 7.0 | |
| Ex. 3 | Y3-1 | 0 | 13.2 | 0 | 14.2 | 7.0 | No |
| | M3-1 | 0 | 11.3 | 0 | 12.2 | 7.0 | |
| | C3-1 | 0 | 12.9 | 0 | 13.2 | 6.9 | |
| | BK3-1 | 0 | 11.9 | 0 | 11.9 | 6.8 | |
| | Y3-2 | 0 | 15.4 | 0 | 16.2 | 6.7 | Yes |
| | M3-2 | 0 | 13.7 | 0 | 14.7 | 6.8 | |
| | C3-2 | 0 | 14.2 | 0 | 13.7 | 7.0 | |
| | BK3-2 | 0 | 13.8 | 0 | 13.7 | 6.9 | |
| Ex. 4 | Y4-1 | 0 | 0.8 | 0 | 2.3 | 7.0 | No |
| | M4-1 | 0 | 0.7 | 0 | 1.9 | 7.1 | |
| | C4-1 | 0 | 0.6 | 0 | 2.2 | 7.2 | |
| | BK4-1 | 0 | 0.9 | 0 | 2.1 | 7.0 | |
| | Y4-2 | 0 | 1.3 | 0 | 2.5 | 7.1 | Yes |
| | M4-2 | 0 | 1.4 | 0 | 2.6 | 7.0 | |
| | C4-2 | 0 | 1.2 | 0 | 2.7 | 7.0 | |
| | BK4-2 | 0 | 1.3 | 0 | 2.4 | 7.1 | |
| Ex. 5 | Y1-1-5 | 0 | 16.3 | 0 | 18.1 | 5.1 | No |
| | M1-1-5 | 0 | 11.2 | 0 | 13.3 | 4.9 | |
| | C1-1-5 | 0 | 12.1 | 0 | 14.2 | 5.0 | |
| | BK1-1-5 | 0 | 10.8 | 0 | 13.1 | 5.1 | |
| | Y1-2-5 | 0 | 15.3 | 0 | 17.2 | 5.2 | Yes |
| | M1-2-5 | 0 | 12.3 | 0 | 15.3 | 5.3 | |
| | C1-2-5 | 0 | 13.1 | 0 | 16.1 | 5.1 | |
| | BK1-2-5 | 0 | 12.1 | 0 | 15.1 | 5.0 | |
| Ex. 6 | Y1-1-9 | 0 | 14.6 | 0 | 15.2 | 9.1 | No |
| | M1-1-9 | 0 | 12.4 | 0 | 13.2 | 9.2 | |
| | C1-1-9 | 0 | 13.5 | 0 | 13.5 | 9.3 | |
| | BK1-1-9 | 0 | 12.1 | 0 | 11.9 | 9.0 | |
| | Y1-2-9 | 0 | 15.8 | 0 | 17.3 | 8.8 | Yes |
| | M1-2-9 | 0 | 13.2 | 0 | 15.5 | 8.9 | |
| | C1-2-9 | 0 | 14.1 | 0 | 16.1 | 9.0 | |
| | BK1-2-9 | 0 | 15.5 | 0 | 15.1 | 9.1 | |
| Com. | Y5-1 | 2 | 13.3 | 8 | 15.2 | 6.8 | No |
| Ex. 1 | M5-1 | 20 | 11.8 | 7 | 13.2 | 6.9 | |
| | C5-1 | 19 | 12.2 | 9 | 14.7 | 7.1 | |
| | BK5-1 | 5 | 12.1 | 3 | 13.5 | 7.2 | |
| | Y5-2 | 5 | 15.2 | 8 | 18.8 | 7.1 | Yes |
| | M5-2 | 75 | 13.3 | 15 | 17.1 | 7.0 | |
| | C5-2 | 63 | 14.1 | 23 | 16.9 | 6.9 | |
| | BK5-2 | 10 | 13.9 | 10 | 17.0 | 7.0 | |
| Com. | Y6-1 | 0 | 0.7 | 1 | 0.9 | 7.1 | No |
| Ex. 2 | M6-1 | 1 | 0.6 | 1 | 0.9 | 7.2 | |
| | C6-1 | 2 | 0.8 | 0 | 1.0 | 7.1 | |
| | BK6-1 | 0 | 0.9 | 0 | 0.9 | 7.0 | |
| | Y6-2 | 0 | 1.1 | 2 | 1.5 | 6.9 | Yes |
| | M6-2 | 7 | 1.3 | 3 | 1.6 | 7.0 | |
| | C6-2 | 5 | 1.4 | 1 | 1.7 | 6.9 | |
| | BK6-2 | 0 | 1.2 | 0 | 1.5 | 7.0 | |
| Com. | Y5-1-5 | 4 | 15.3 | 10 | 16.2 | 5.2 | No |
| Ex. 3 | M5-1-5 | 51 | 13.4 | 15 | 14.2 | 5.1 | |
| | C5-1-5 | 31 | 14.4 | 16 | 15.4 | 4.9 | |
| | BK5-1-5 | 8 | 12.5 | 4 | 13.7 | 5.0 | |
| | Y5-2-5 | 9 | 16.2 | 15 | 18.2 | 5.0 | Yes |
| | M5-2-5 | 105 | 13.3 | 32 | 15.5 | 5.1 | |
| | C5-2-5 | 151 | 13.8 | 41 | 16.8 | 5.2 | |
| | BK5-2-5 | 23 | 12.9 | 15 | 15.5 | 4.9 | |

TABLE 1-continued

| | Toner | Two component developer: Number of aggregate (pieces) | Two component developer: Glossiness (%) | One component developer: Number of white streaks (pieces) | One component developer: Glossiness (%) | Volume average particle diameter (μm) | Inclusion of wax |
|---|---|---|---|---|---|---|---|
| Com. Ex. 3 | Y5-1-9 | 1 | 15.8 | 4 | 16.2 | 9.0 | No |
| | M5-1-9 | 15 | 13.9 | 4 | 14.2 | 9.0 | |
| | C5-1-9 | 14 | 14.7 | 3 | 14.9 | 9.1 | |
| | BK5-1-9 | 3 | 13.1 | 2 | 12.6 | 8.8 | |
| | Y5-2-9 | 2 | 16.1 | 0 | 17.2 | 8.9 | Yes |
| | M5-2-9 | 35 | 13.2 | 7 | 15.3 | 9.0 | |
| | C5-2-9 | 41 | 15.2 | 13 | 15.5 | 9.1 | |
| | BK5-2-9 | 5 | 12.9 | 8 | 13.8 | 9.2 | |

As can be understood from Table 1, the toner of the present invention, which includes a binder resin including a polyester resin which is prepared by a polycondensation reaction using a catalyst selected from the group consisting of halogenated titanium, titanium diketone enolates, titanium carboxylates, titanyl carboxylates, and salts of titanyl carboxylates, can produce glossy full color images without image defects (such as white streaks) while hardly causing aggregation of toner particles. Even when a wax is included in the toner and the gloss of images is further increased, the toner particles hardly cause the aggregation problem.

This document claims priority and contains subject matter related to Japanese Patent Application No. 2003-326035, filed on Sep. 18, 2003, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner for forming a full color image, comprising:

a colorant; and a binder resin including a polyester resin which is prepared by a polycondensation esterification reaction in the presence of a titanium-containing catalyst selected from the group consisting of halogenated titanium, titanium diketone enolate, titanium carboxylate, titanyl carboxylate, and salts of titanyl carboxylate, wherein the toner has a volume average particle diameter of from 5 to 7.5 μm.

2. The toner according to claim 1, further comprising a wax.

3. The toner according to claim 1, wherein the polyester resin has a number average molecular weight (Mn) of from 2,000 to 5,000 and a weight average molecular weight (Mw) of from 10,000 to 30,000.

4. A toner kit comprising:

a yellow toner;

a cyan toner;

a magenta toner; and a black toner, wherein each of the toners is the toner according to claim 1.

5. The toner kit according to claim 4, wherein each of the toners further comprises a wax.

6. The toner kit according to claim 4, wherein the polyester resin has a number average molecular weight (Mn) of from 2,000 to 5,000 and a weight average molecular weight (Mw) of from 10,000 to 30,000.

7. An image forming apparatus comprising:

an image bearing member;

a charger configured to charge the image bearing member;

a light irradiator configured to irradiate the image bearing member with imagewise light to form an electrostatic latent image on the image bearing member;

a developing device configured to develop the electrostatic latent image with a developer comprising the toner according to claim 1 to prepare a toner image on the image bearing member;

a transfer device configured to transfer the toner image on a receiving material; and a fixing device configured to fix the toner image on the receiving material, wherein the toner has a volume average particle diameter of from 5 to 7.5 μm.

8. The image forming apparatus according to claim 7, wherein the toner further comprises a wax.

9. The image forming apparatus according to claim 7, wherein the polyester resin has a number average molecular weight (Mn) of from 2,000 to 5,000 and a weight average molecular weight (Mw) of from 10,000 to 30,000.

10. The image forming apparatus according to claim 7, wherein the toner image fixed on the receiving material has a glossiness of from 5 to 80%.

11. A process cartridge comprising:

a developing device configured to develop an electrostatic latent image with a developer comprising the toner according to claim 1 to prepare a toner image; and a housing.

12. The process cartridge according to claim 11, wherein the toner further comprises a wax.

13. The process cartridge according to claim 11, wherein the polyester resin has a number average molecular weight (Mn) of from 2,000 to 5,000 and a weight average molecular weight (Mw) of from 10,000 to 30,000.

* * * * *